US007168801B2

(12) United States Patent
Hwang et al.

(10) Patent No.: US 7,168,801 B2
(45) Date of Patent: Jan. 30, 2007

(54) INK CARTRIDGE

(75) Inventors: Hyung-hyu Hwang, Suwon-si (KR); Seo-hyun Cho, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 192 days.

(21) Appl. No.: 10/756,275

(22) Filed: Jan. 14, 2004

(65) Prior Publication Data

US 2004/0145637 A1 Jul. 29, 2004

(30) Foreign Application Priority Data

Jan. 28, 2003 (KR) ..... 10-2003-0005631
Dec. 3, 2003 (KR) ..... 10-2003-0087383

(51) Int. Cl.
*B41J 2/17* (2006.01)
*B41J 2/175* (2006.01)

(52) U.S. Cl. ..... 347/87; 347/86

(58) Field of Classification Search ..... 347/84, 347/85, 86, 87

See application file for complete search history.

(56) References Cited

U.S. PATENT DOCUMENTS 6,007,191 A * 12/1999 Fujii et al. ..... 347/87
6,102,533 A * 8/2000 Nozawa et al. ..... 347/86
6,170,941 B1 * 1/2001 Hara et al. ..... 347/86
6,234,615 B1 * 5/2001 Tsukuda ..... 347/85
6,238,042 B1 * 5/2001 Kobayashi et al. ..... 347/86
6,250,750 B1 * 6/2001 Miyazawa et al. ..... 347/87
6,623,092 B2 * 9/2003 Kim et al. ..... 347/7
6,776,479 B2 * 8/2004 Ardito et al. ..... 347/86
6,986,569 B2 * 1/2006 Toba et al. ..... 347/86
2002/0021341 A1 * 2/2002 Higuma et al. ..... 347/86
2002/0180847 A1 * 12/2002 Jones et al. ..... 347/86

FOREIGN PATENT DOCUMENTS

JP 09-085963 3/1997
JP 10-100434 4/1998
JP 10-109428 4/1998
JP 10-250102 9/1998
JP 2002-019141 1/2002

* cited by examiner

*Primary Examiner*—Manish S. Shah
*Assistant Examiner*—Han Samuel Choi
(74) *Attorney, Agent, or Firm*—Stanzione & Kim, LLP

(57) ABSTRACT

An ink cartridge includes a container body to accommodate an ink and having a pipe at a lower end through which the ink is discharged, an ink holding member disposed in the container body to absorb the ink, and a negative pressure generation part stepped with respect to a reference bottom side in the container body to increase a negative pressure by compressing the ink holding member as approaching an inlet of the pipe.

47 Claims, 9 Drawing Sheets

INK CARTRIDGE

CROSS-REFERENCE TO RELATED APPLICATIONS

This application claims the benefit of Korean Patent Application Nos. 2003-5631 filed Jan. 28, 2003 and 2003-87383 filed Dec. 3, 2003 in the Korean Intellectual Property Office, the disclosures of which are incorporated herein by reference in their entirety.

BACKGROUND OF THE INVENTION

1. Field of the Invention

The present invention generally relates to an ink cartridge, and more specifically, to an ink cartridge that improves the flow of ink therein.

2. Description of the Related Art

In general, ink is filled in a main body of ink cartridges of an inkjet printer and jetted in a predetermined amount through ink nozzles formed in the main body to print an image on papers.

FIG. 1 is a cross-sectional view illustrating a conventional ink cartridge. Referring to FIG. 1, a container body 3 of the ink cartridge 1 accommodates an ink holding member 2 that absorbs the ink. An ink supply pipe 4 is formed below the container body 3 in fluid communication with an ink head (not shown). An inlet of the ink supply pipe 4 is formed in the container body 3 and protrudes from a bottom side of the container body 3 to a predetermined height. Around the protruding inlet of the ink supply pipe 4, the ink holding member 2 is compressed/pressed, and as a result, greater capillary force occurs in comparison with an adjacent area to efficiently feed the ink to the ink head. A cover 5 of the container body 3 includes a discharge hole 5*a* and an ink injection hole 5*b* that fluidly communicate with the outside. A filter 6 is installed at the inlet of the ink supply pipe 4 to block the inflow of contaminants that might be included in the inks.

With the above configuration, when the ink is injected from the ink head, additional ink is absorbed to the ink head through the ink supply pipe 4 by the capillary force of the ink supply pipe 4 in the same amount as the injected ink from the container body 3. By repeating the above operations, the image is printed and the amount of the ink in the container body 3 is gradually reduced while flowing downward due to the weight-thereof. Since the area where the compression of the ink holding member 2 is greatest, that is, the contact area compressed by the inlet of the ink supply pipe 4 has the greatest capillary force, the ink flows towards the inlet of the ink supply pipe 4.

However, the ink is drawn toward the inlet of the ink supply pipe 4 only within a range where the capillary force exists, which occurs by the compression of the inlet of the ink supply pipe 4. In other words, the ink does not move at corners within the container body 3 or edges within the container 3 far from the ink supply pipe 4 where the capillary force does not reach.

Unused ink remaining at the corners within the container body 3 deteriorates the utility of the ink. Thus, to obtain desired ink utility, the size of the ink cartridge has to be enlarged, while the currently available inkjet printers tend to be light-weighted, compact-sized, and portable, it is not easy to manufacture compact-sized ink cartridges due to the above problems.

SUMMARY OF THE INVENTION

Accordingly it is an aspect of the present invention to solve the above and/or other problems and disadvantages by providing an improved ink cartridge capable of effectively moving the ink in a container body toward an ink supply pipe.

Additional aspects and/or advantages of the invention will be set forth in part in the description which follows and, in part, will be obvious from the description, or may be learned by practice of the invention.

The foregoing and/or other aspects of the present invention are achieved by providing an ink cartridge including a container body to accommodate an ink, the container body having a pipe at a lower end through which the ink is discharged, an ink holding member disposed in the container body to absorb the ink, and a negative pressure generation part stepped with respect to a reference bottom side in the container body to increase a negative pressure by compressing the ink holding member more while approachingan inlet of the pipe.

In another aspect of the present invention, the negative pressure part protrudes from the reference bottom side within the container body, and has at least more than one protruding rib formed to gradually slope upward toward the pipe.

In another aspect of the present invention, the negative pressure generation part includes a plurality of protruding ribs which are radially disposed on the pipe.

In yet another aspect of the present invention, the protruding ribs are disposed at intervals.

In yet another aspect of the present invention, the protruding ribs extend from a boundary between a bottom and a side wall in the container body to the inlet of the pipe.

In yet another aspect of the present invention, the negative pressure generation part is formed by depressing the reference bottom side of the container body at a predetermined depth. The negative pressure generation part has a boundary rib disposed between inclined depressions, which becomes more shallow while approaching the inlet of the pipe.

In yet another aspect of the present invention, the negative pressure generation part includes a plurality of boundary ribs which are radially disposed on the inlet of the pipe.

In yet another aspect of the present invention, the boundary ribs extend toward the inlet of the pipe from the boundary between the bottom and the side wall in the container body.

In yet another aspect of the present invention, the reference bottom side of the container body is a horizontal surface which is perpendicular, or substantially perpendicular to the pipe.

In yet another aspect of the present invention, the container body includes a negative pressure chamber having the pipe, the ink holding member, and the negative pressure generation part at the bottom thereof, and an ink chamber separated from the negative pressure chamber by a partition having a communication hole formed in a lower end thereof through which the ink and air are exchanged.

In yet another aspect of the present invention, the negative pressure generation part has a protruding rib protruding from the bottom of the negative pressure chamber and extending to the pipe.

In yet another aspect of the present invention, the protruding rib is formed to slope upward to the pipe.

In yet another aspect of the present invention, the negative pressure generation part includes at least more than one protruding rib. The protruding ribs protrude from the reference bottom side of the negative pressure chamber and gradually slope upward to the pipe.

In yet another aspect of the present invention, the negative pressure generation part includes a plurality of protruding ribs, and one of the protruding ribs extends from the communication hole to the inlet of the pipe.

In yet another aspect of the present invention, the negative pressure generation part includes a plurality of protruding ribs, and the protruding ribs are radially disposed on the pipe in the negative pressure chamber.

In yet another aspect of the present invention, the reference bottom side of the negative pressure chamber comprises an inclined surface sloping downward to the pipe from the communication hole.

In yet another aspect of the present invention, the negative pressure generation part is formed by depressing the reference bottom surface of the negative pressure generation part, and the negative pressure generation part has a boundary rib formed between the inclined depressions and having a smaller depth while approaching the pipe.

In yet another aspect of the present invention, the negative pressure generation part also includes a blockage prevention part outwardly extending with respect to the bottom of the container body to prevent the ink holding member from blocking the communication hole.

In yet another aspect of the present invention, the blockage prevention part comprises a depression formed by depressing the reference bottom side of the negative pressure chamber at a predetermined depth.

In yet another aspect of the present invention, the negative pressure generation part comprises a protruding rib extending and gradually sloping upward to the pipe from the depression.

In still another aspect of the present invention, the protruding rib is formed to slope upward from corners of the container body to the pipe at a predetermined slope.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
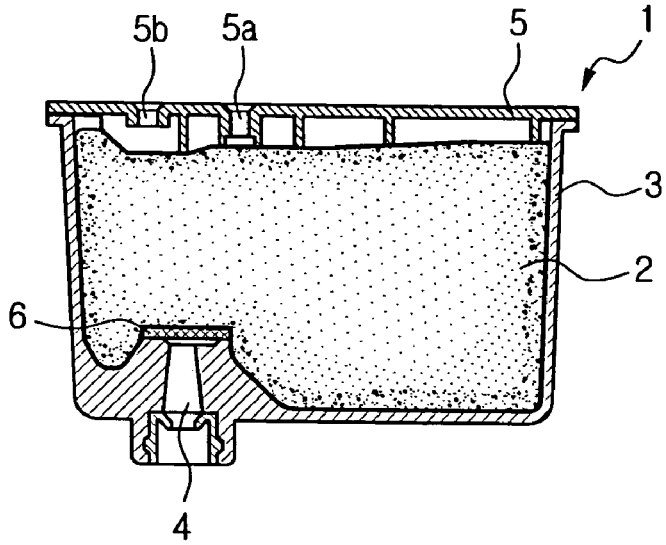
FIG. 1 (PRIOR ART)
FIG. 1 is a cross-sectional view illustrating a conventional ink cartridge.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
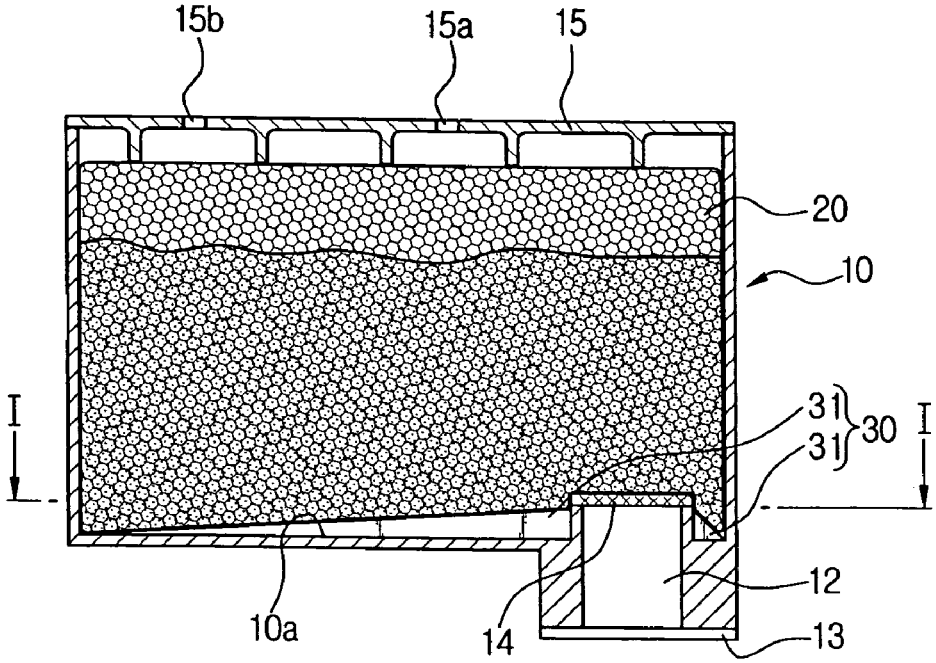
FIG. 2 is a cross-sectional view illustrating an ink cartridge according to an embodiment of the present invention.

Referring to FIG. 2, an ink cartridge according to this embodiment of the present invention includes a container body 10, an ink holding member 20 accommodated within the container body 10 to absorb ink, and a negative pressure generation part 30 disposed on a bottom side of the container body to increase a negative pressure by compressing the ink holding member 20.

The container body 10 includes a predetermined space in which the ink is accommodated. A pipe 12 is disposed under the container body 10' so that the ink is discharged therethrough. An ink head 13 is disposed at an outer end of the pipe 12 to inject the ink onto a printing paper and a filter 14 is disposed at an inlet of the pipe 12 to filter any contaminants that might be contained in the ink. The pipe 12 may be integrally formed with the container body 10.

An ink injection hole 15*a* and an air through hole 15*b* are formed at a cover 15 of the container body 10.

A reference bottom side 10*a* in the container body 10 is a horizontal surface which is perpendicular, or substantially perpendicular to the pipe 12. The inlet of the pipe 12 and the filter 14 protrude higher than the reference bottom side 10*a* of the container body 10.

The ink holding member 20 may be made of porous or textile materials that generate negative pressure while being compressed in the container body 10, although other materials that perform the desired functions of the present invention can also be used alternatively. The ink holding member 20 is compressed and accommodated within the container body 10.

The negative pressure generation part 30 includes at least one or more protruding ribs 31 which protrude from the reference bottom side 10*a* of the container body 10 to cause the negative pressure in the ink holding member 20. The protruding ribs 31 are formed to gradually slope upward toward the pipe 12. Accordingly, the ink holding member 20 is more compressed as it approaches the pipe 12 while in contact with the sloped protruding ribs 31, and has more pores per inch (PPI) as it approaches the pipe 12. As a result, the ink held in the ink holding member 20 concentrates around the pipe 12 where more PPI are distributed and smoothly flows into the pipe 12.

Figure 3:
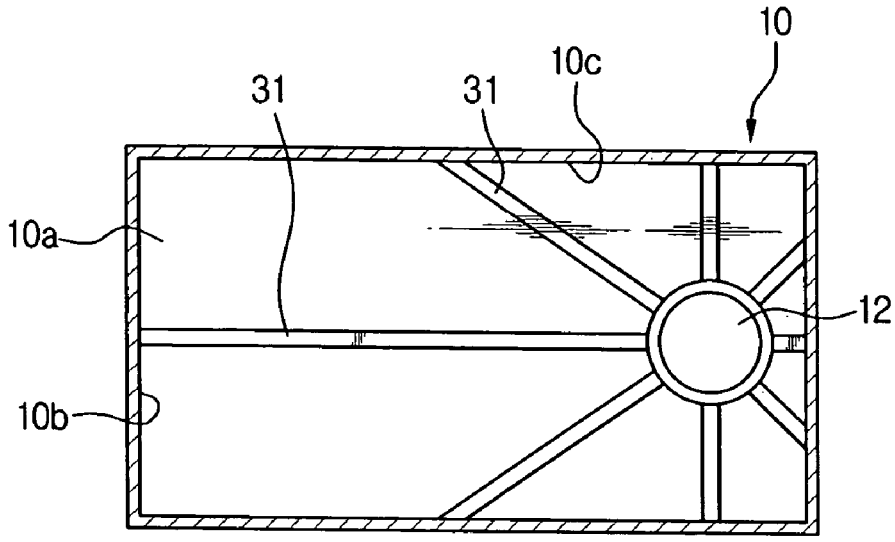
FIG. 3 is a cross-sectional view illustrating the ink cartridge in FIG. 2 taken along the line I—I.

The protruding ribs 31 are integrally formed within the container body 10. As shown in FIG. 3, the protruding ribs 31 can be radially, or substantially radially disposed based on the pipe 12. Each of the protruding ribs 31 extends to the inlet of the pipe 12 from the boundary between the reference bottom side 10*a* and side walls 10*b* and 10*c*. Preferably, the protruding ribs 31 respectively are disposed at intervals and formed to slope upward toward the pipe 12 at a predetermined slope. As a result, at a lower part of the ink holding member 20, the negative pressure is incrementally generated from the corners to the pipe 12 within the container body 10, and the ink located far from the pipe 12 in the container body 10 can be drawn to the pipe 12 and used for the printing.

According to the embodiment of the present invention as described above, the protruding ribs 31 are formed protruding from the reference bottom surface 10*a* of the container body 10 so that the negative pressure at the lower end of the pipe 12 is incremented upwardly along the pipe 12. Since even the ink located far from the pipe 12 is prevented from staying far from the pipe 12, the entire ink can be smoothly supplied and used, unlike in the conventional ink cartridge. As a result, the ink utility is improved and the compact-sized ink cartridge can be manufactured.

Figure 4:
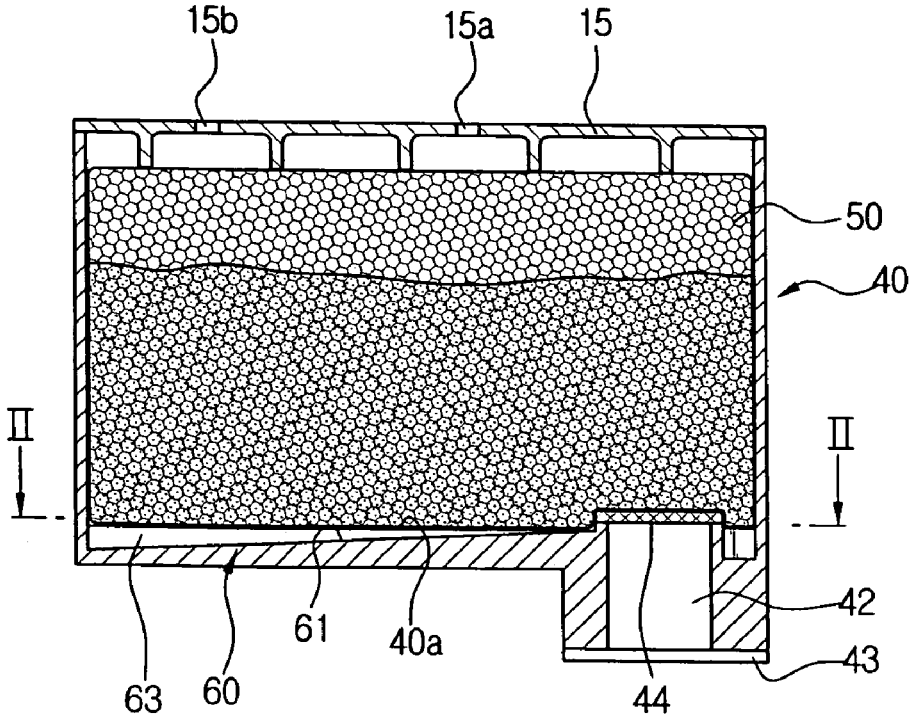
FIG. 4 is a cross-sectional view illustrating an ink cartridge according to another embodiment of the present invention.
Figure 5A:
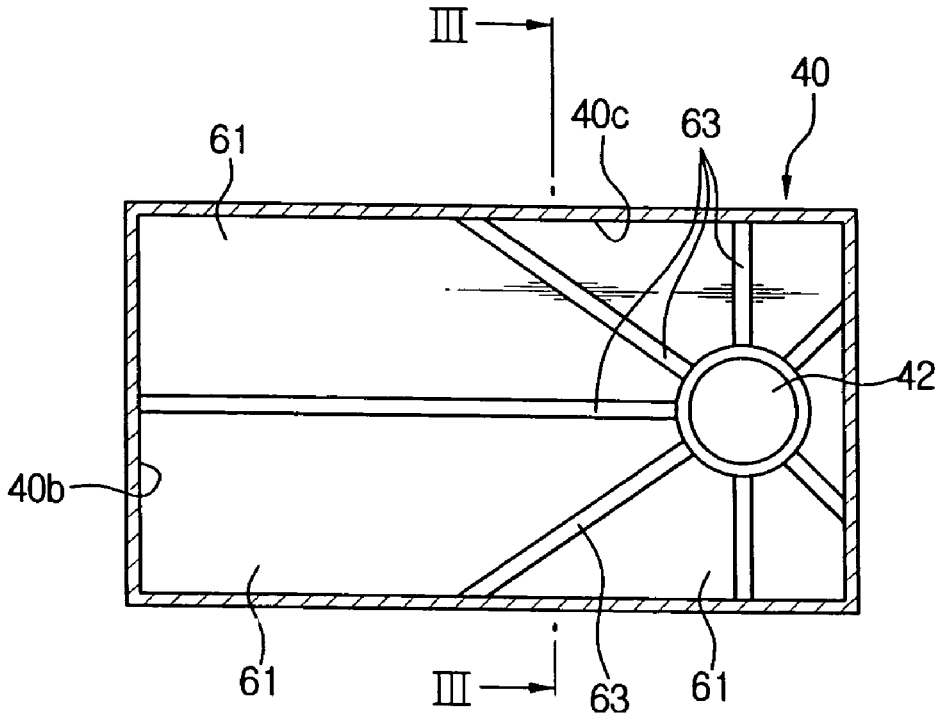
FIG. 5A is a cross-sectional view illustrating the ink cartridge in FIG. 4 taken along the line II—II.
Figure 5B:
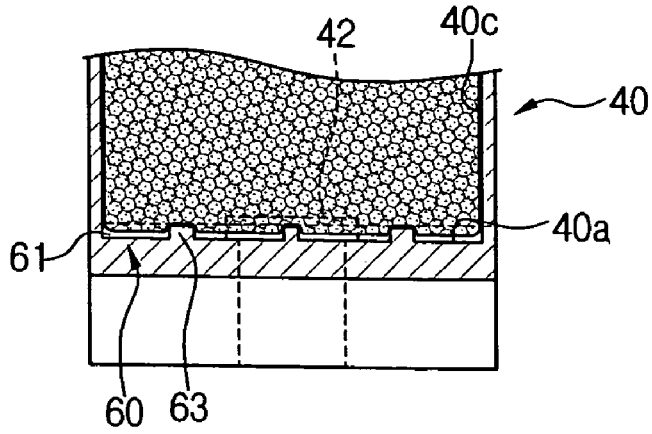
FIG. 5B is a cross-sectional view illustrating the ink cartridge in FIG. 5 taken along the line III—III.

Referring FIGS. 4, 5A, and 5B, an ink cartridge according to another embodiment of the present invention includes a container body 40 to accommodate the ink, an ink holding member 50 made of porous materials and disposed in the container body 40, and a negative pressure generation part 60 to gradually increase and concentrate the negative pressure around a pipe 42 which is disposed at a lower end of the container body 40.

The configuration of the container body 40 is substantially identical to that of the container body 10 of FIG. 2 except for the configuration of the negative pressure generation part 60.

The pipe 42 is formed at a lower end of the container body 40 and is in an upright position with respect to the lower end of the container body 40. An ink head 43 is disposed at an outer lower end of the pipe 42, and a filter 44 is disposed at an inlet of the pipe 44.

The ink holding member 50 has the same configuration and operations as the ink holding member 20 of FIG. 2, and therefore a detailed description of the ink holding member 50 will be omitted for conciseness.

The negative pressure generation part 60 includes a boundary rib 63 disposed between each set of two adjacent inclined depressions 61. The inclined depressions 61 are formed by depressing a reference bottom side 40*a* of the container body 40 at a predetermined depth and the inclined depressions 61 become more shallow while approaching the pipe 42. Each of the inclined depressions 61 has a different plane shape with respect to each other, as shown in FIG. 5A. The boundary ribs 63 are disposed between the inclined depressions 61 and have the same thickness as a bottom wall of the container body 40. That is, upper sides of the boundary ribs 63 are the reference bottom side 40*a* of the container body 40, and perpendicular, or substantially perpendicular to the pipe 42.

The negative pressure generation part 60 includes a plurality of the boundary ribs 63 radially disposed with respect to the pipe 42. Since the inclined depressions 61 become more shallow as they approach the pipe 42, a lower part of the ink holding member 50 is increasingly compressed. Thus, relatively greater capillary force occurs around the vicinity of the pipe 42. That is, around the pipe 42, the density of the ink holding member 50 increases and the PPI increases. As a result, because the negative pressure gradually increases as it approaches the pipe 42 from the edges or corners of the container body 40, the ink is delivered smoothly and the ink utility improves.

The inclined depressions 61 can be formed to slope upward toward the pipe 42 at a predetermined slope. In this case, the negative pressure generates at the lower end of the ink holding member 50 and linearly increases to allow smooth movement of the ink. The width and the number of the inclined depressions 61 can be appropriately determined in consideration of the size of the container body 40, though other configurations can be adequately implemented.

The protruding rib 31 of FIG. 2 and the boundary rib 63 of FIG. 4 may be linearly formed at a predetermined length. Although not shown in the figures, the protruding rib 31 and the boundary rib 63 may be formed up to a predetermined distance from the pipes 12 and 42, respectively, and not around the pipes 12 and 42, in which the same effect may be obtained.

Figure 6:
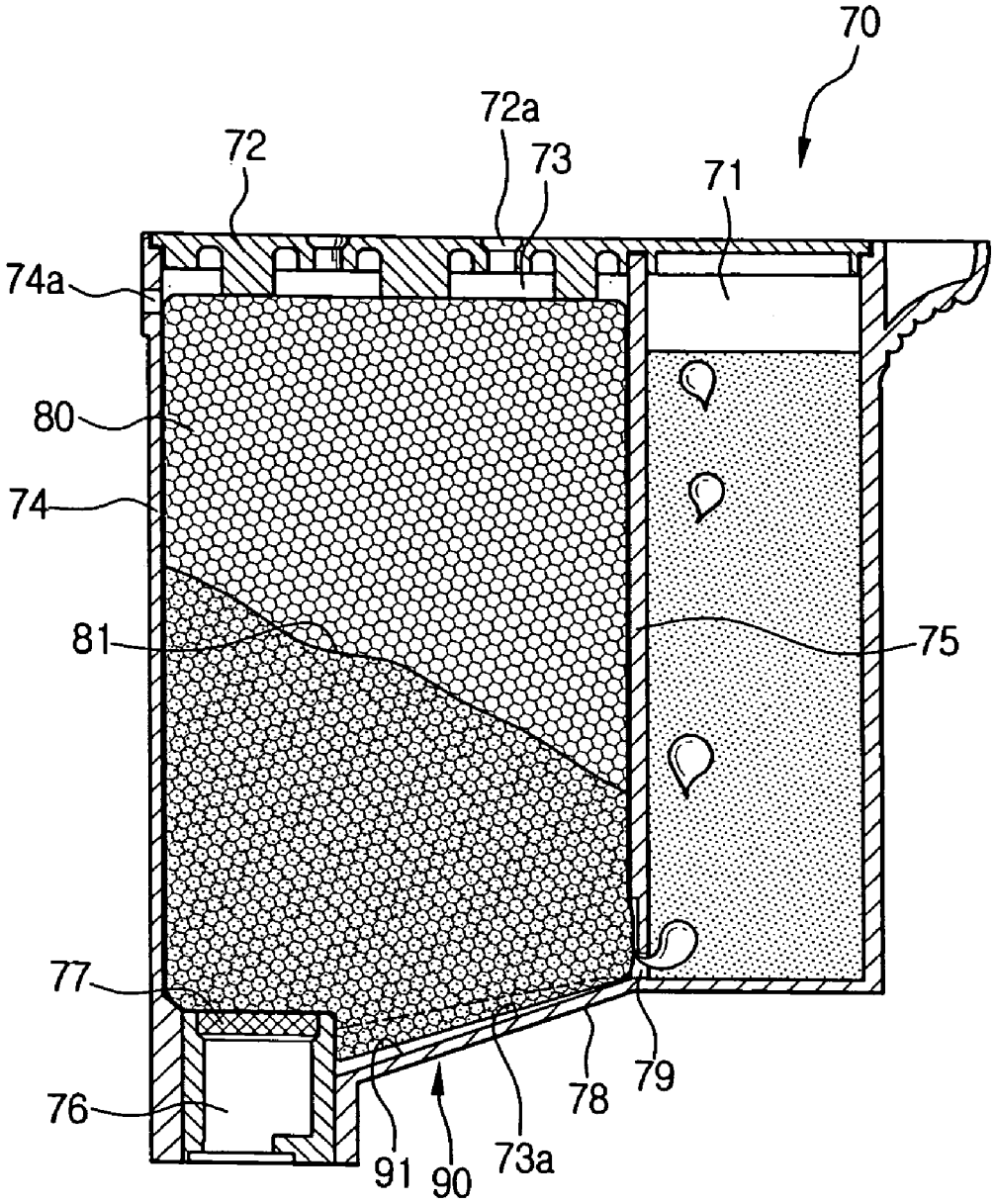
FIG. 6 is a cross-sectional view illustrating an ink cartridge according to yet another embodiment of the present invention.

FIG. 6 illustrates an ink cartridge according to yet another embodiment of the present invention.

Referring to FIG. 6, the ink cartridge includes a container body 70 partitioned into an ink chamber 71 and a negative pressure chamber 73, an ink holding member 80 disposed in the negative pressure chamber 73, and a negative pressure generation part 90 formed on a bottom of the negative pressure chamber 73.

The container body 70 is closed by a cover 72 which is disposed at an upper side thereof. The cover 72 has an air through hole 72*a*. An ink injection hole 74*a* is formed at an upper side of a side wall 74 of the container body 70. The negative pressure chamber 73 accommodates the ink holding member 80 absorbing the ink, and the ink chamber 71 accommodates the ink. The negative pressure chamber 73 and the ink chamber 71 are divided by a partition 75 vertically installed in the container body 70.

A pipe 76 is formed under the negative pressure chamber 73 to discharge the ink, and a filter 77 is disposed at an inlet of the pipe 76.

A communication hole 79 is formed between a lower end of the partition 75 and a base wall 78. Air in the negative pressure chamber 73 and the ink in the ink chamber 71 fluidly communicates through the communication hole 79. When the ink in the negative pressure chamber 73 is initially used to some extent, the ink accommodated in the ink chamber 71 moves through the communication hole 79 and fills the ink holding member 80 in the negative pressure chamber 73.

A reference bottom side 73*a* in the negative pressure chamber 73 is an inclined surface gradually sloping downward from the communication hole 79 to the pipe 76. Hence, the inlet of the pipe 76 is positioned lower than the communication hole 79.

The negative pressure generation part 90 includes a protruding rib 91. The protruding rib 91 is formed by protruding from the reference bottom side 73*a* to a predetermined height and extends from the communication hole 79 to the inlet of the pipe 76. The height of the protruding rib 91 gradually increases as it approaches the pipe 76 from the communication hole 79 to increase the negative pressure toward the sloped part. Accordingly, the ink, moved to the negative pressure chamber 73 from the ink chamber 71 through the communication hole 79, is smoothly supplied to the pipe 76 by the gradually increasing capillary force. Since more ink is concentrated around the pipe 76, the flow of air bubbles in the negative pressure chamber 73 is led to the communication hole 79 to which less ink is concentrated. Consequently, the ink level in the negative pressure chamber 73 inclines to the communication hole 79 to improve the exchange efficiency of the ink in the ink chamber 71 and the air bubbles in the negative pressure chamber 73 when a certain amount of the ink in the negative pressure chamber 73 is consumed.

Figure 7:
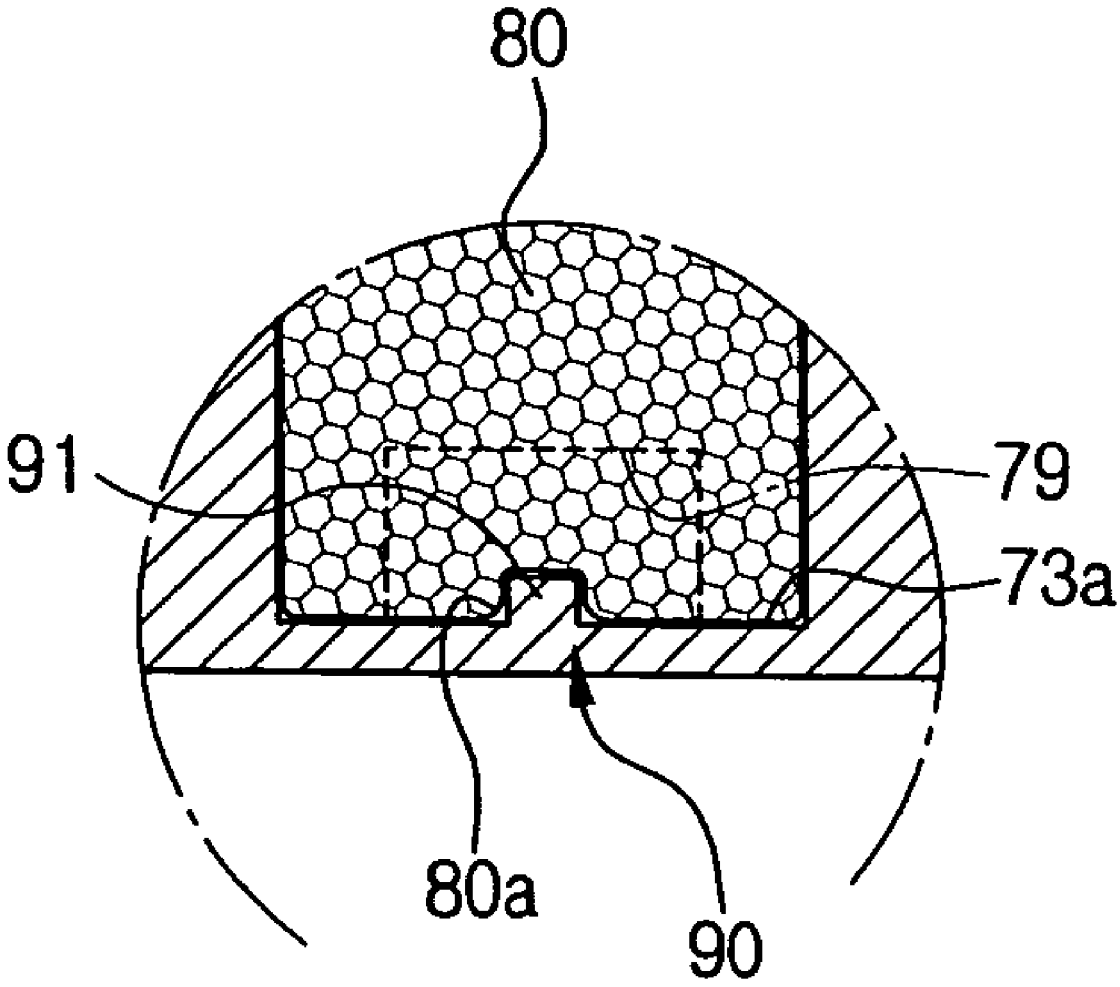
FIG. 7 is a cross-sectional view illustrating main parts of the ink cartridge in FIG. 6.

Referring to FIG. 7, the protruding rib 91 protrudes from the reference bottom side 73*a* of the container body 70 and has a portion higher than a bottom of the communication hole 79 and lower than a top of the communication hole 79. Accordingly, the upper side of the protruding rib 91 is stepped with respect to the reference bottom side 73*a*.

The stepped area between the protruding rib 91 and the reference bottom side 73*a* partially accommodates a lower end part 80*a* of the ink holding member 80 which fills the negative pressure chamber 73 by foaming or compression. A gap is formed between the partially accommodated lower end part 80*a* of the ink holding member 80 and a side wall of the protruding rib 91, as shown in FIG. 7. The ink in the ink chamber 71 may flow into the gap through the communication hole 79.

As configured and shaped above, the lower end part 80*a* of the ink holding member 80 is prevented from blocking the communication hole 79, and relatively large air bubbles can smoothly move into the ink chamber 71. The negative pressure generation part 90 gradually increases the negative pressure as it approaches the pipe 76 from the communication hole 79 and also prevents the lower end part 80*a* of the ink holding member 80 from blocking the communication hole 79.

In molding the container body 70, the negative pressure generation part 90 may be integrally formed with the container body 70. Also, the protruding rib 91 may be formed at a predetermined distance from the communication hole 79 toward the pipe 76.

In the present embodiment as shown in FIG. 6, though a single protruding rib 91 is formed, the ink utility can be sufficiently enhanced since the reference bottom side 73*a* is formed sloping downward to the pipe 76 and the negative pressure is concentrated toward the pipe 76.

Figure 8:
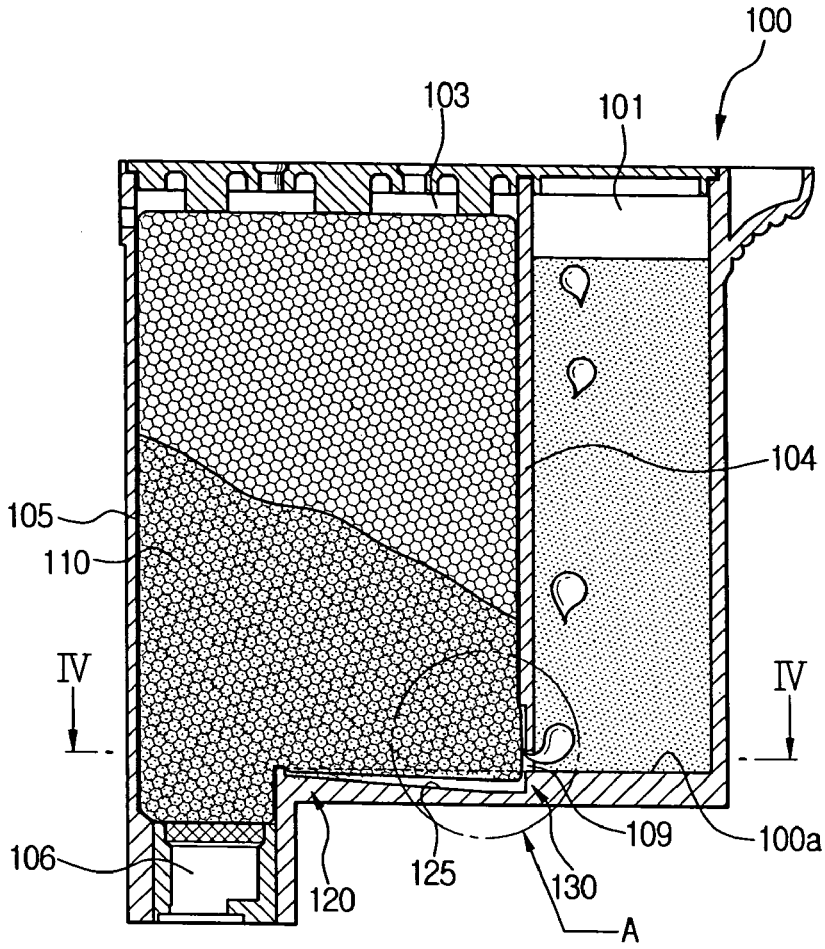
FIG. 8 is a cross-sectional view illustrating an ink cartridge according to yet another embodiment of the present invention.

Referring to FIG. 8, an ink cartridge according to yet another embodiment of the present invention includes a container body 100 having an ink chamber 101 and a negative pressure chamber 103, an ink holding member 110 disposed in the negative pressure chamber 103, and a negative pressure generation part 120 disposed on a bottom side of the negative pressure chamber 103.

A reference bottom side 100*a* of the container body 100 is a horizontal surface which is perpendicular, or substantially perpendicular to a pipe 106. The ink is discharged through the pipe 106. The ink chamber 101 and the negative pressure chamber 103 are divided by a partition 104. A communication hole 109 is formed between a lower end of the partition 104 and the reference bottom side 100*a*, through which the ink in the ink chamber 101 and an air in the negative pressure chamber 103 are exchanged.

Figure 9A:
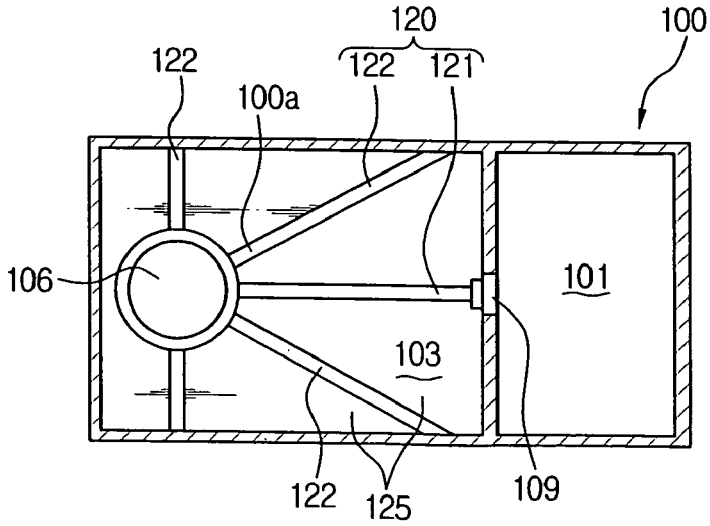
FIG. 9A is a cross-sectional view illustrating the ink cartridge in FIG. 8 taken along the line IV—IV.

According to the present embodiment as constructed above, the pipe 106 is adjacent to a side wall 105 which is far from the communication hole 109. Hence, the negative pressure generation part 120 is disposed in the negative pressure chamber 103 to efficiently deliver the ink moved into the negative pressure chamber 103 through the communication hole 109 toward the pipe 106. As shown in FIG. 9A, the negative pressure chamber 120 includes boundary ribs 121 and 122 disposed at boundaries between a plurality of inclined depressions 125. The inclined depressions 125 are formed by depressing the reference bottom side 100*a* of the negative pressure chamber 103. The boundary ribs 121 and 122 are formed at a predetermine height from a frame or corners far from the pipe 106 toward the pipe 106. Instead, each inclined depression 125 becomes more shallow as it approaches the pipe 106 to incline at a predetermined slope. One (the boundary rib 121) of the boundary ribs 121 and 122 extends from the communication hole 109 toward the pipe 106. As in the embodiments illustrated in FIGS. 2 and 4, the boundary ribs 121 and 122 of this embodiment cause a negative pressure over a lower side of the ink holding member 110 and the negative pressure gradually increases toward the pipe 106 so that the ink is prevented from staying at the corners of the negative pressure chamber 103.

The boundary ribs 121 efficiently deliver the ink supplied from the ink chamber 101 through the communication hole 109. Specifically, as the incline depressions 125 approach the pipe 106, the inclined depressions 125 around the boundary rib 121 become more shallow and stepped with respect to the lower side of the ink holding member 110. Accordingly, the lower side of the ink holding member 110 is more compressed in the area adjacent to the pipe 106 to increase the negative pressure and smoothly deliver the ink.

Figure 9B:
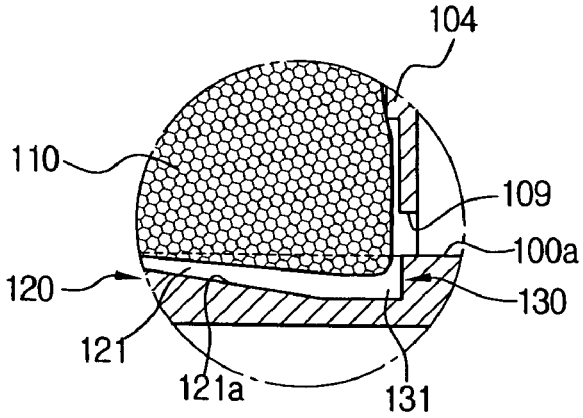
FIG. 9B is a cross-sectional view illustrating an enlarged "A" area in FIG. 8.

A blockage prevention part 130 is provided to prevent the ink holding member 110 from blocking the communication hole 109. The blockage prevention part 130 includes a depression 131 (FIG. 9B) stepped on the reference bottom side 100*a* at a predetermined depth. Preferably, the depression 131 is connected with the boundary rib 121. As shown in FIG. 9B, when the lower part of the ink holding member 110 is partially inserted into the depression 131, a gap is formed between the bottom of the depression 131 and the ink holding member 110. Accordingly, the communication hole 109 is not blocked and the ink smoothly moves through the communication hole 109.

In this embodiment of the present invention, the plurality of inclined depressions 125 and the boundary ribs 121 and 122 formed on the bottom of the negative pressure chamber 103 are described by way of example. Alternatively, only the boundary rib 121 can be formed to extend from the communication hole 109 toward to the pipe 106, and still the same effect may be obtained.

Figure 10:
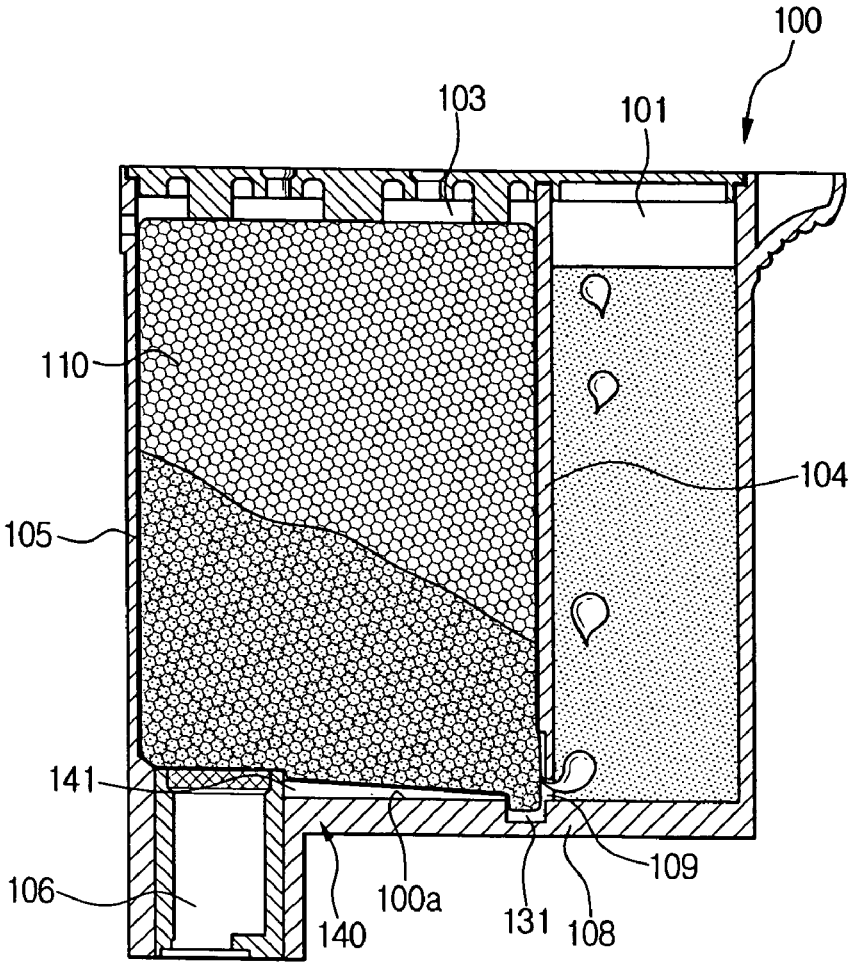
FIG. 10 is a cross-sectional view illustrating an ink cartridge according to yet another embodiment of the present invention.

Referring to FIG. 10, an ink cartridge according to yet another embodiment of the present invention has the same configuration as the ink cartridge in FIG. 8 except for a negative pressure generation part 140. The negative pressure generation part 140 includes at least more than one protruding rib 141 formed on a reference bottom side 100*a* of a negative pressure chamber 103 at a predetermined height. The reference bottom side 100*a* is horizontal. The protruding rib 141 gradually slopes upward to a pipe 106. Accordingly, a lower end part of an ink holding member 110 has the negative pressure gradually increasing as it approaches the pipe 106 due to the protruding rib 141.

Figure 11:
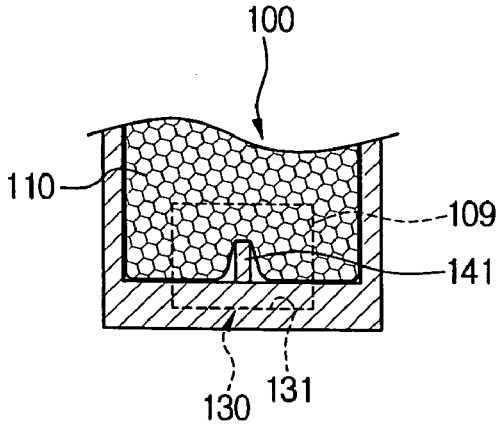
FIG. 11 is a cross-sectional view illustrating main parts of the ink cartridge in FIG. 10.

A plurality of the protruding ribs 141 may be used and disposed radially, or substantially radially based on the pipe 106 similarly to the boundary ribs 121 and 122 in FIG. 8. According to one example of the present embodiment of the present invention, the protruding rib 141 extends from the communication hole 109 toward the pipe 106. Though only a single protruding rib 141 is formed, the ink can be efficiently delivered from a distance far from the pipe 106. As shown in FIG. 11, the lower part of the ink holding member 110 is pressed by the protruding rib 141 to increase the negative pressure as it approaches the pipe 106. Since the protruding rib 141 is adjacent to the communication hole 109, a gap is formed between the lower part of the ink holding member 110 raised by the protruding rib 141 and the reference bottom side 100*a* of container body 100. As result, the protruding rib 141 may prevent the ink holding member 110 from blocking the communication hole 109 to some extent.

To effectively prevent the ink holding member 110 from blocking the communication hole 109, a blockage prevention part 130 is disposed on the reference bottom side 100*a* of the container body 100 corresponding to the communication hole 109 as in the embodiment of FIG. 8. The blockage prevention part 130 is a depression 131 with respect to the reference bottom side 100*a* of the container 100 and is connected with the protruding rib 141.

In the example shown in FIG. 10, the depression 131 is formed in a base wall 108 of the container body 100. In this case, the base wall 108 is thickened to reinforce its hardness.

Figure 12:
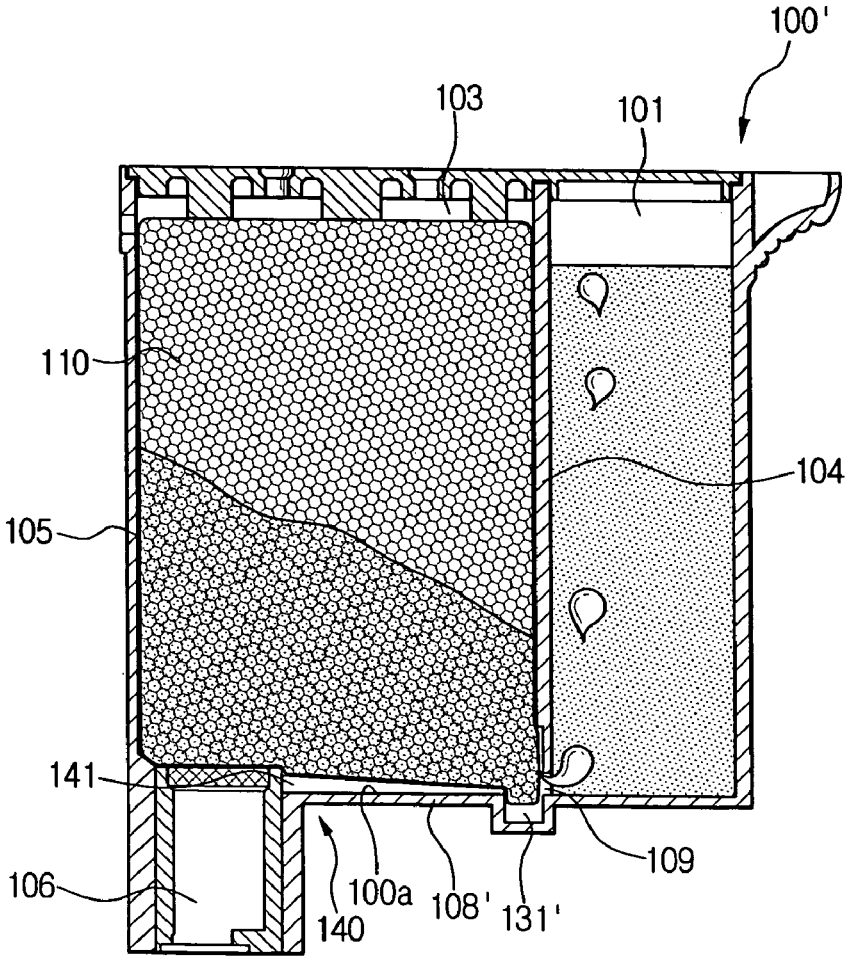
FIG. 12 is a cross-sectional view illustrating an ink cartridge according to yet another embodiment of the present invention.

In another embodiment of the present invention, as shown in FIG. 12, a base wall 108' may not be thickened, and in this case, a container body 100' may be formed to a predetermined thickness by protruding a depression 131' outside of the base wall 108'. As a result, the same effect can be obtained as with the ink cartridge in FIG. 10 with the reduced requirement of materials for the manufacture thereof.

Figure 13A:
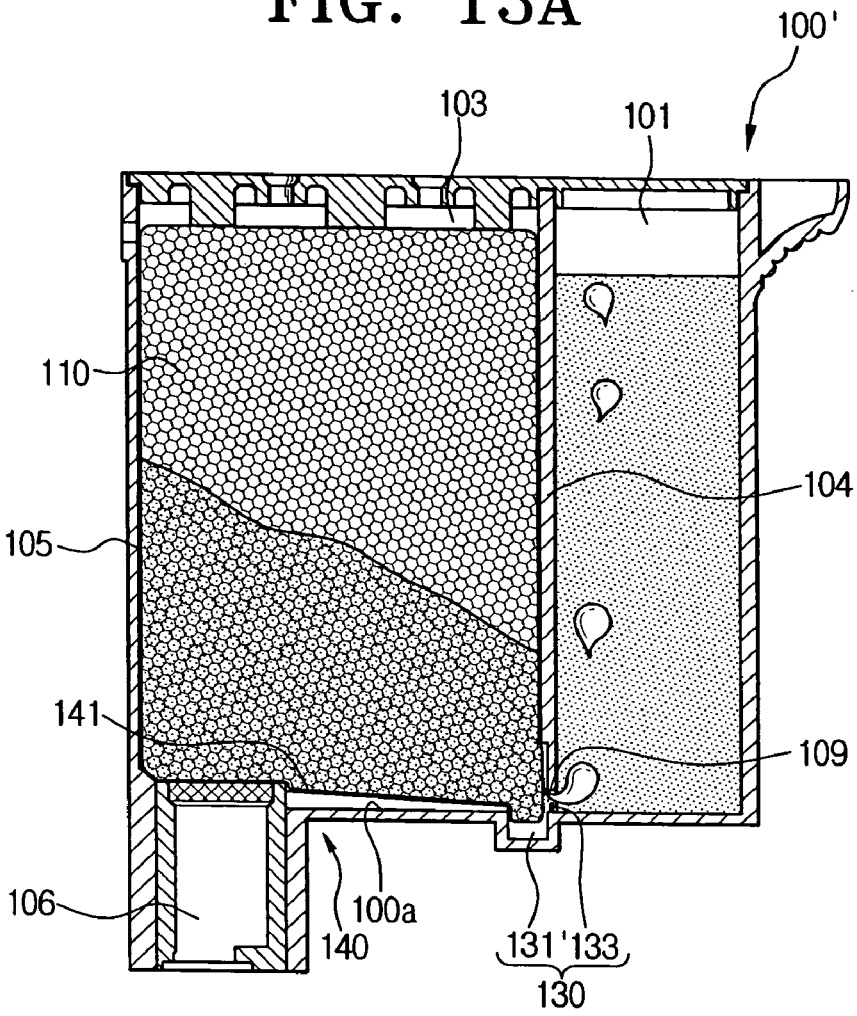
FIG. 13A is a cross-sectional view illustrating an ink cartridge according to yet another embodiment of the present invention.
Figure 13B:
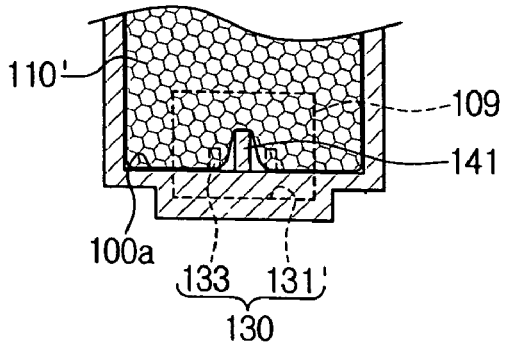
FIG. 13B is a cross-sectional view illustrating main parts of the ink cartridge in FIG. 13A.

As shown in FIGS. 13A and 13B, a plurality of protruding ribs 133 may be formed to partially block a lower part of the communication hole 109. The protruding ribs 133 and the depression 131' constitute the blockage prevention part to prevent the blockage of the communication hole 109. The protruding ribs 133 can be selectively used in a two chamber type ink cartridge having a communication hole.

Although not shown in the drawing figures, the protruding ribs and the inclined depressions may be selectively formed on the reference bottom side of the ink cartridge. In disposing the protruding ribs and the inclined depressions, the position, the intervals, and the slope with respect to the reference bottom side may appropriately vary according to the volume and the shape of the ink cartridge.

According the above embodiments of the present invention, the negative pressure generation part is formed on the bottom of the container body to cause the negative pressure to increase as it approaches the pipe. Thus, the ink at the corners of the container body can be efficiently delivered and used to thus improve the ink utility and manufacture of the compact-sized ink cartridge.

The two chamber type ink cartridge, in which the ink chamber and the negative pressure chamber are divided, includes the negative pressure generation part on the bottom of the ink chamber to smoothly deliver the ink within the cartridge. The negative pressure generation part is formed between the communication hole and the pipe to effectively draw the ink delivered from the ink chamber into the negative pressure chamber.

The blockage prevention part is formed adjacent to the communication hole and prevents the blockage of the communication hole due to the lower end part of the ink holding member. As a result, the air and the ink smoothly exchange through the communication hole to efficiently supply the ink.

The negative pressure generation part may be connected to the blockage prevention part and function as the blockage prevention part to thus improve the ink utility.

While the preferred embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. An ink cartridge comprising:

a container body to accommodate an ink, the container body having a pipe at a lower end through which the ink is discharged;

an ink holding member disposed in the container body to absorb the ink; and a negative pressure generation part comprising at least one rib protruding from a reference bottom of the container body, extending from at least one reference side of the container body to the pipe, and having a height that changes from the at least one reference side to the pipe to increase a negative pressure by compressing the ink holding member as it approaches an inlet of the pipe.

2. The ink cartridge of claim 1, wherein the at least one rib gradually slopes upward to the pipe.

3. The ink cartridge of claim 2, wherein the at least one rib comprises a plurality of protruding ribs radially disposed on the pipe.

4. The ink cartridge of claim 3, wherein the protruding ribs are disposed at intervals.

5. The ink cartridge of claim 2, wherein the protruding ribs extend from a boundary between a bottom and a side wall in the container body to the inlet of the pipe.

6. The ink cartridge of claim 1, wherein the negative pressure generation part is formed by depressing the reference bottom side of the container body at a predetermined depth, and the negative pressure generation part has a boundary rib disposed between inclined depressions which become more shallow while approaching the inlet of the pipe.

7. The ink cartridge of claim 6, further comprising a plurality of boundary ribs radially disposed on the inlet of the pipe.

8. The ink cartridge of claim 6, wherein the boundary rib extends toward the inlet of the pipe from the boundary between the bottom and the side wall in the container body.

9. The ink cartridge of claim 7, wherein the plurality of boundary ribs extend toward the inlet of the pipe from the boundary between the bottom and the side wall in the container body.

10. The ink cartridge of claim 1, wherein the reference bottom side of the container body is a horizontal surface which is perpendicular or substantially perpendicular to the pipe.

11. The ink cartridge of claim 1, wherein the container body comprises:

a negative pressure chamber having the pipe, the ink holding member, and the negative pressure generation part at the bottom thereof; and an ink chamber separated from the negative pressure chamber by a partition and having a communication hole formed at a lower end of the partition through which the ink and air are exchanged.

12. The ink cartridge of claim 11, wherein the negative pressure generation part has a protruding rib protruding from the bottom of the negative pressure chamber and extending to the pipe.

13. The ink cartridge of claim 12, wherein the protruding rib slopes upward to the pipe.

14. The ink cartridge of claim 12, wherein the negative pressure generation part comprises at least more than one protruding rib gradually sloping upward to the pipe.

15. The ink cartridge of claim 14, wherein the negative pressure generation part comprises a plurality of protruding ribs, one of the plurality of protruding ribs extending from the communication hole to the inlet of the pipe.

16. The ink cartridge of claim 10, wherein the negative pressure generation part comprises a plurality of protruding ribs radially disposed on the pipe in the negative pressure chamber.

17. The ink cartridge of claim 11, wherein the reference bottom side of the negative pressure chamber comprises an inclined surface sloping downward to the pipe from the communication hole.

18. The ink cartridge of claim 11, wherein the negative pressure generation part is formed by depressing the reference bottom surface of the negative pressure generation part and the negative pressure generation part has a boundary rib formed between the inclined depressions and having a decreasing depth while approaching the pipe.

19. The ink cartridge of claim 11, further comprising a blockage prevention part outwardly extending with respect to the bottom of the container body to prevent the ink holding member from blocking the communication hole.

20. The ink cartridge of claim 19, wherein the blockage prevention part comprises a depression formed by depressing the reference bottom side of the negative pressure chamber at a predetermined depth.

21. The ink cartridge of claim 20, wherein the negative pressure generation part comprises a protruding rib extending and gradually sloping upward to the pipe from the depression.

22. The ink cartridge of claim 2, wherein the at least one rib is formed to slope upward from corners of the container body to the pipe at a predetermined slope.

23. The ink cartridge of claim 11, wherein the negative pressure generation part has a plurality of protruding ribs formed to slope upward from corners of the container body to the pipe at a predetermined slope.

24. The ink cartridge of claim 1, wherein the negative pressure generation part comprises:

a plurality of inclined depressions formed by depressing the reference bottom side of the container at a predetermined depth, the inclined depressions becoming more shallow while approaching the pipe; and a boundary rib disposed between each adjacent set of inclined depressions.

25. The ink cartridge of claim 24, wherein each of the inclined depressions has a different plane shape with respect to each other.

26. The ink cartridge of claim 25, wherein each of the boundary ribs have the same thickness as a bottom wall of the container body such that the upper sides of each of the boundary ribs are the reference bottom side of the container body, and are substantially perpendicular to the pipe.

27. The ink cartridge of claim 26, wherein the boundary ribs are radially disposed with respect to the pipe.

28. The ink cartridge of claim 24, wherein the inclined depressions are formed to slope toward the pipe at a predetermined slope.

29. The ink cartridge of claim 24, wherein the number of inclined depressions is proportional to the size of the container body.

30. The ink cartridge of claim 11, wherein the height of the protruding rib gradually increases while approaching the pipe from the communication hole.

31. The ink cartridge of claim 11, wherein the reference bottom side of the negative pressure changer comprises an inclined slope from the pipe to the communication hole.

32. The ink cartridge of claim 31, wherein the protruding rib protrudes from the reference bottom side of the negative pressure chamber at a height lower than the communication hole such that the upper side of the protruding rib is stepped with respect to the reference bottom side of the container body.

33. The ink cartridge of claim 32, wherein the stepped area partially accommodates a lower end part of the ink holding member such that a gap is formed between the partially accommodated lower end part of the ink holding member and a side wall of the protruding rib to allow the ink to flow into the gap through the communicating hole.

34. The ink cartridge of claim 11, wherein the negative pressure generating part is integrally formed with the container body.

35. An ink cartridge comprising:

a container body to accommodate ink therein and having a pipe to discharge ink externally;

an ink holding member disposed within the container body to absorb the ink; and a negative pressure generating part to create a negative pressure within the container body which increases proportionally closer to the pipe to efficiently feed the ink to the pipe to be discharged therethrough.

36. The ink cartridge of claim 35, wherein the at least one rib gradually slopes toward the pipe to increase compression and a number of pores per square inch of the ink holding member more toward the pipe.

37. The ink cartridge of claim 35, wherein the negative pressure generating part comprises:

inclined depressions that become more shallow while approaching the pipe to increasingly compress a lower part of the ink holding member toward the pipe; and a boundary rib positioned between each adjacent set of inclined depressions and radially disposed with respect to the pipe.

38. An ink cartridge comprising:

a container body to accommodate ink therein and having a pipe to discharge ink externally, the container body being partitioned into an ink chamber and a negative pressure chamber containing the pipe therein;

an ink holding member disposed within the negative pressure chamber to absorb the ink received from the ink chamber; and a negative pressure generating part disposed within the negative pressure chamber to create an negative pressure therein which increases proportionally closer toward the pipe to efficiently feed the ink to the pipe to be discharged therethrough.

39. The ink cartridge of claim 38, further comprising:

a communication hole to communicate the ink from the ink chamber to the negative pressure chamber, the communication hole being positioned at a higher location than the pipe; and a sloped bottom surface of the negative pressure chamber gradually sloping downward away from the communication hole and toward the pipe.

40. The ink cartridge of claim 39, further comprising a protruding rib formed to protrude along the bottom surface and having a height that gradually increases from the communication hole to the pipe, the protruding rib creating a gap between a lower part of the ink holding member and a side wall of the protruding rib to prevent ink from blocking the communication hole and to increase the negative pressure toward the pipe.

41. The ink cartridge of claim 38, further comprising:

a communication hole to communicate the ink from the ink chamber to the negative pressure chamber;

a plurality of inclined depressions formed in a bottom of the negative pressure generating part, the plurality of inclined depressions gradually sloped to become more shallow toward the pipe; and boundary ribs positioned between respective boundaries between adjacent inclined depressions to cause a negative pressure over a lower side of the ink holding member such that the negative pressure increases gradually toward the pipe.

42. The ink cartridge of claim 41, wherein one of the boundary ribs extends from the communication hole toward the pipe.

43. The ink cartridge of claim 42, further comprising a blockage prevention part having a depression stepped on the bottom of the negative pressure chamber and connected with the boundary rib such that a part of the ink holding member is inserted into the depression to form a gap between the bottom of the depression and the ink holding member to prevent blockage of the communication hole.

44. The ink cartridge of claim 38, further comprising:

a communication hole to communicate the ink from the ink chamber to the negative pressure chamber;

a horizontal bottom surface of the negative pressure chamber; and at least one protruding rib positioned along the bottom surface and gradually sloped upward from the communication hole to the pipe to cause an increasing negative pressure over a lower side of the ink holding member toward the pipe.

45. The ink cartridge of claim 44, further comprising a blockage prevention part disposed within the bottom surface of the negative pressure chamber in correspondence with the communication hole, and having a depression in connection with the protruding rib such that a gap is formed between the ink holding member and the depression to prevent ink from blocking the communication hole.

46. The ink cartridge of claim 44, further comprising a blockage prevention part disposed to protrude through and below the bottom surface of the negative pressure chamber in correspondence with the communication hole, and having a depression in connection with the protruding rib such that a gap is formed between the ink holding member and the depression to prevent ink from blocking the communication hole.

47. The ink cartridge of claim 46, further comprising a plurality of second protruding ribs formed at predetermined positions and intervals on the bottom the container body to partially block a lower part of the communication hole and work together with the depression to prevent blockage of the communication hole.

* * * * *